US005468402A

United States Patent [19]

Hachiya et al.

[11] Patent Number: 5,468,402

[45] Date of Patent: Nov. 21, 1995

[54] LUBRICANT FOR USE IN HOT ROLLING OF STAINLESS STEEL

[75] Inventors: Seio Hachiya; Ken-ichi Shinoda, both of Tokyo; Yuichi Higo, Hiroshima, all of Japan

[73] Assignee: Nisshin Steel Co., Ltd., Tokyo, Japan

[21] Appl. No.: 927,265

[22] PCT Filed: Mar. 28, 1990

[86] PCT No.: PCT/JP90/00415

§ 371 Date: Sep. 21, 1992

§ 102(e) Date: Sep. 21, 1992

[87] PCT Pub. No.: WO91/14757

PCT Pub. Date: Oct. 3, 1991

[30] Foreign Application Priority Data

Sep. 28, 1987 [JP] Japan ..... 62-243099

[51] Int. Cl.[6] ..... C10M 173/00

[52] U.S. Cl. ..... 252/25; 252/49; 252/49.3

[58] Field of Search ..... 252/49, 49.3, 25

[56] References Cited

FOREIGN PATENT DOCUMENTS 63-234092 9/1988 Japan .
3-091596 4/1991 Japan .

OTHER PUBLICATIONS

Kirk—Othmer. Encyclopedia of Chemical Technology. vol. 8 1981 pp. 900–930.

*Primary Examiner*—Jacqueline V. Howard
*Assistant Examiner*—Cephia Toomer
*Attorney, Agent, or Firm*—Lowe, Price, Leblanc & Becker

[57] ABSTRACT

An aqueous lubricant for use in hot rolling of stainless steel to prevent roll scoring which comprises a viscous aqueous having dispersed therein from 1 to 30% by weight of iron oxide powder.

9 Claims, 1 Drawing Sheet

LUBRICANT FOR USE IN HOT ROLLING OF STAINLESS STEEL

FIELD OF THE INVENTION

The invention relates to a lubricant for use in hot rolling of stainless steel to prevent roll scoring (Ritzbildung an Rolle).

BACKGROUND OF THE INVENTION

Since a beautiful surface texture is required for stainless steel articles, in the production of stainless steel formation of surface defects should be controlled as far as possible. However, when stainless steel is hot rolled by means of a tandem mill, a very small surface part of the material being rolled may be picked up by rolls and transferred to the entity of the material. Repetitions of such phenomena may frequently result in roll scoring and in turn surface defects of a hot rolled product, which are brought to the subsequent cold rolling step and deteriorate a surface quality of a cold rolled product. The surface defects of the cold rolled product, even if they are of a slight extent, not only limit application of the product, for example, make the product unsuitable for use in mirror finished applications, but also require to be remedied by polishing for use in other applications. The surface defects of a great extent invite an economical loss, since the product is only useful as a scrap.

To solve the problem of surface defects of stainless steel products caused by rjoll scoring, several approaches have heretofore been made. In one approach, rolling conditions, including reduction in rolling load have been studied. However, up to now no satisfactory solution has been obtained by this approach.

In another approach, roll material has been studied and there has been proposed that use of grain rolls having a suitable surface roughness in hot rolling of stainless steel is effective to prevent roll scoring. However, if such a grain roll is used in an initial stage of the hot rolling step where a rolling load is large (that is in the first to third stands of a hot rolling mil), the roll is considerably worn, resulting in a stepped wear, whereby a freedom of inverse rolling which is indispensable in the modern rolling technology is lost. Furthermore, with mild steels grain rolls generally provide more or less worse surface texture. Accordingly, use of grain rolls does not provide a complete solution in the the modern rolling technology where schedule free rolling is intended or where rolling of various steel species with one and the same mill is intended.

In a further approach, use of lubricant oils has been studied. The presence of a lubricant oil between the rolling rolls and the material to be rolled effectively lowers the friction coefficient, and thus, use of lubricant oils is fairly prevailing in rolling of mild steels. Similar effect is expected in the case of stainless steels and use of lubricant oils has been considered to be effective in hot rolling of stainless steels to prevent roll scoring. However, with known animal and vegetable fats and oils, and known mineral and synthetic lubricants, satisfactory effects to prevent roll scoring are not achieved in hot rolling of stainless steels.

On the other hand, for the purposes of schedule free rolling or rolling of various steel species with one and the same mill, it is frequently desirable to use high chromium rolls as work rolls in initial stages of hot rolling where a rolling load is fairly large. However, high chromium rolls only pose a more serious problem of roll scoring when used in hot rolling of stainless steel, since they have a chemical composition similar to the rolled material.

In any event occurrence of roll scoring not only renders the surface quality of the products poor but also invites problems of increase of costs and time for roll exchange.

OBJECT OF THE INVENTION

An object of the invention is to provide a lubricant for use in hot rolling of stainless steel which effectively prevents roll scoring even when high chromium work rolls are employed and even when the hot rolling is carried out at a temperature as high as 900° to 1200° C. and under a pressure as high as 10 to 50 kg/mm$^2$.

SUMMARY OF THE INVENTION

The invention provides an aqueous lubricant for use in hot rolling of stainless steel which comprises a viscous aqueous solution having dispersed therein from 1 to 30% by weight of iron oxide powder. The aqueous mixture should preferably have a viscosity within the range between $1\times10^3$ and $5\times10^5$ cP (centipoise). At least 90% by weight of the iron oxide powder should have a particle size not exceeding 10 μm. The viscous aqueous solution may be prepared by dissolving a water soluble high molecular weight thickener in water.

DETAILED DESCRIPTION OF THE INVENTION

Figure 1:
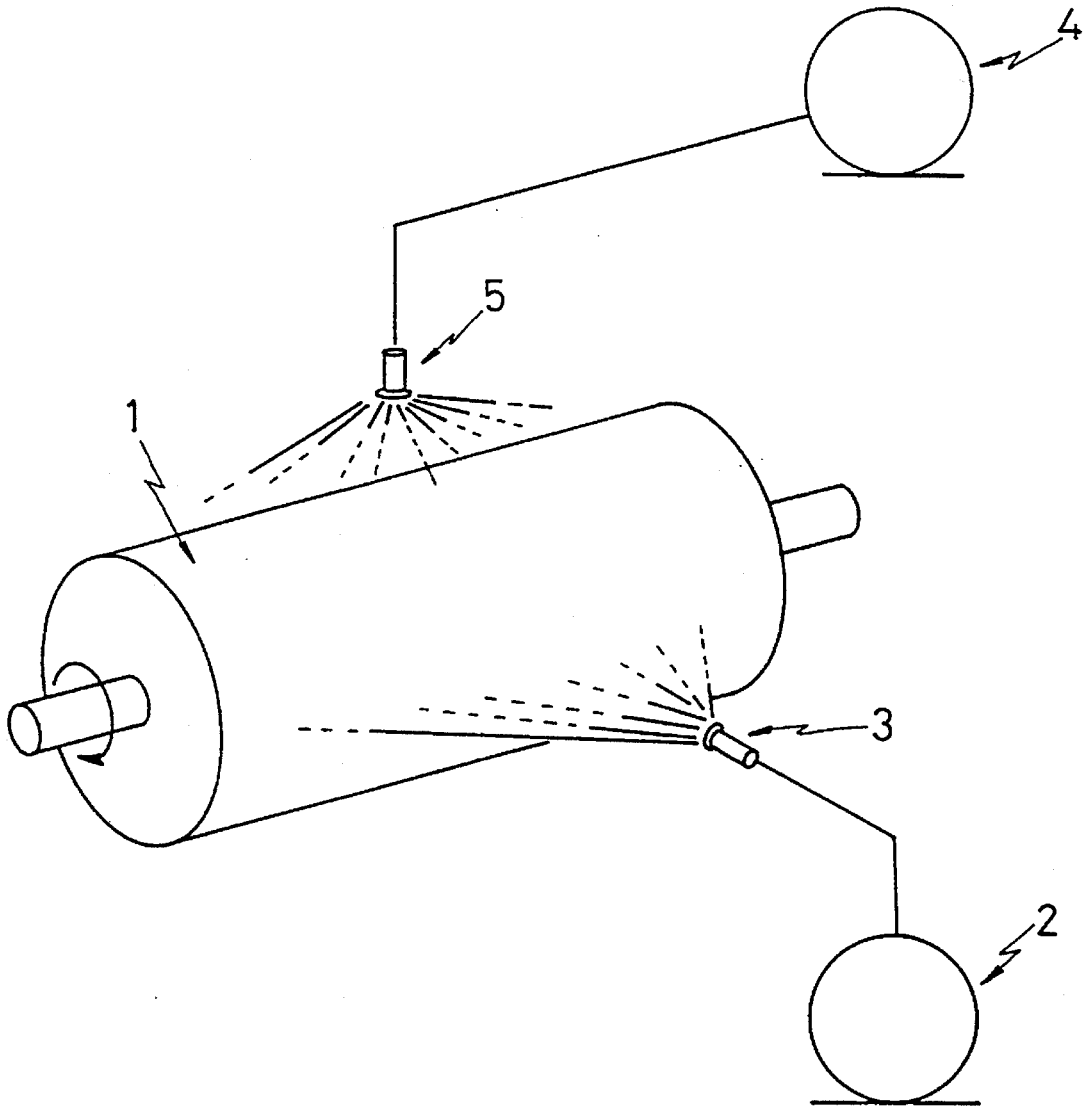
FIG. 1 schematically shows an assembly used in a test for examining a loading of iron oxide powder to a roll.

For a long time we have studied roll scoring upon hot rolling of stainless steel. As a result we have found that one cause of roll scoring resides in high speed rolling of a big slab under high pressure. We have further found that since stainless steel is oxidation resistive, its velocity of forming surface scale is slow, and thus, when a fresh metal surface is formed during high speed multiple stage hot rolling of stainless steel, there is no time enough to form a scale layer sufficient to protect the fresh metal surface; and for these reasons pickup of steel by rolls and roll scoring are particularly peculiar to stainless steel. Our experience that roll scoring more frequently occurs in a tandem mill where the rolling speed is higher than in a steckel mill indicates the importance of protection by scale. Based upon the above-mentioned discovery that the excellent oxidation resistance of stainless steel can be a cause of roll scoring during hot rolling of stainless steel, we have reached an idea of supplying iron oxide from the exterior to supplement the lacking scale and have provided an aqueous lubricant for use in hot rolling of stainless steel according to the invention which effectively prevents roll scoring and can be practically used without troubles. Thus, the basic concept of the invention is to prevent metal to metal touch between the hot rolling rolls and the stainless steel to be rolled by supplementing iron oxide, thereby eliminating a cause of roll scoring. For this purpose it is essential to supply the iron oxide to the rolls in the form of an aqueous mixture having dispersed therein from 1 to 30% by weight of iron oxide powder, the viscosity of the aqueous mixture being adjusted so that a good loading of the iron oxide powder on the rolls may be ensured.

In the aqueous lubricant according to the invention, the iron oxide powder is an essential component to achieve the desired effect of preventing roll scoring. It must be included in the aqueous lubricant in an amount of from 1 to 30% by weight. With substantially less than 1% by weight of the iron oxide, an appreciable effect of preventing roll scoring is not achieved. If the content of the iron oxide in the aqueous lubricant substantially exceeds 30% by weight, an unduly high energy will be required to spray such a lubricant over the rolls , and in addition, a trouble of clogging of pipes for supplying such a lubricant will happen due to precipitation of the iron oxide powder in the pipes. As the iron oxide use can be made of FeO, $Fe_2O_3$ or $Fe_3O_4$ alone or in combination. The iron oxide is not necessarily of high purity, and may be contaminated with a minor amount of impurities such as $SiO_2$, MnO and iron powder. Thus, use can be conveniently made of dust which is formed in a steel making process and primarily comprises iron oxide.

The lubricant according to the invention is an aqueous dispersion of iron oxide, which is thickened to an appropriate viscosity by a water soluble high molecular weight compound. Examples of the water soluble high molecular weight compound which can be used herein include, for example, polyacrylic acid, polymethacrylic acid, polyacrylamide, polyethylene oxide, polysodium acrylate, polyvinyl alcohol, and cellulose ethers such as carboxymethyl cellulose and methyl cellulose. The aqueous lubricant according to the invention is preferably neutral or weakly alkaline, because of its low corrosiveness to the rolling equipment. Accordingly, thickeners which provide a stable viscosity under neutral or weakly alkaline conditions are preferred.

We exclude use of fats and oils as a medium for dispersing iron oxide powder. The iron oxide powder is not lipophilic, and does not necessarily form a uniform dispersion in fats and oils. Furthermore, while in order to prevent roll scoring, that is to avoid metal to metal adhesion, it is advantageous to cool the rolls, fats and oils are likely to form an adiabatic film on rolls which is disadvantageous from the view point of cooling rolls.

We also exclude use of mere water, which is not thickened, as a medium for dispersing iron oxide powder. We have found that an aqueous dispersion of iron oxide which is not thickened is practically of no use, because the iron oxide powder is not well loaded on rolls and remarkably precipitates in pipes.

Upon practical use of a solid lubricant material, iron oxide powder, we have extensively studied two important problems. One problem relates to precipitation of the iron oxide powder in pipes, leading to clogging of nozzles and pipes. The other problem relates to loading of the iron oxide powder on rolls. Incidentally, a hot rolling line is sometimes stopped for a period of about one week for repair or other purposes. We have tried to find out the viscosity of the aqueous mixture and the particle size of the iron oxide powder which do not cause the iron oxide in the aqueous mixture staying in pipes to precipitate during that period. We have also tried to find out a relationship between the loading of the iron oxide on rolls and the the viscosity of the aqueous mixture.

First, we have tested the stability of the aqueous mixture for keeping dispersion. In other words we have examined influences of the viscosity of the aqueous mixture and the particle size of the iron oxide powder on precipitation of the iron oxide powder. The test was carried out by preparing various aqueous mixtures having varied viscosities and varied particle size of the iron oxide powder, mixing and settling them and determining the extent of precipitation of the iron oxide powder. The iron oxide powder primarily comprised $Fe_2O_3$ and $Fe_3O_4$, and was used in the test after pulverized to the indicated various particle sizes. As the thickener polyacrylic acid was used. The viscosity of the aqueous mixture was varied by varying the amount of the thickener added to the aqueous mixture. Each tested aqueous mixture was thoroughly mixed, contained in a one liter beaker, and settled for one day or one week. Liquid was sampled from the upper, bottom and middle parts of the beaker, and the content of iron oxide in each sampled liquid was determined. Results are shown in Table 1.

As seen from Table 1, if iron oxide powder having an appropriate particle size is used and if the viscosity is properly adjusted, there can be obtained an aqueous mixture having such an excellent dispersion stability that it does not remarkably cause the iron oxide powder to precipitate even when settled for a week. More specifically, it can be understood from Table 1 that if the iron oxide powder is so fine that at least 90% by weight has a particle size not exceeding 10 μm, it can maintain a uniform dispersion in a thin aqueous mixture having a viscosity as low as $4.8\times10^3$ cP even after the aqueous mixture has been allowed to stand for a week. The iron oxide powder used should preferably be fine enough not to adversely affect the surface quality of the rolled stainless steel. Generally, it is preferred to use fine iron oxide powder having a median size of 1 μm or less.

TABLE 1

| | Viscos- | Size distribution and median size of iron oxide powder | | | | | | Content of iron oxide in aqueous mixture (wt. %) | | | | | | | |
|---|---|---|---|---|---|---|---|---|---|---|---|---|---|---|---|
| | ity of aqueous | ≦1 μm | 1~2 μm | 2~5 μm | | > | Median | Just | After 1 day settlement | | | After 1 week settlement | | | |
| Test No. | mixture cP | (wt. %) | (wt. %) | (wt. %) | 5~10 μm (wt. %) | 10μm (wt. %) | size (μm) | after mixing | Upper layer | Middle layer | Bottom layer | Upper layer | Middle layer | Bottom layer | Re-marks |
| 1 | $1.3\times10^2$ | 64 | 28 | 7 | 1 | 0 | 0.7 | 5.4 | 0 | 2.3 | 18.3 | 0 | 0 | 32.3 | B |
| 2 | $8.2\times10^2$ | 76 | 20 | 4 | 0 | 0 | 0.6 | 5.3 | 3.8 | 4.8 | 8.2 | 2.1 | 4.1 | 12.3 | B |
| 3 | $1.5\times10^3$ | 64 | 28 | 7 | 1 | 0 | 0.7 | 5.1 | 5.0 | 5.3 | 5.3 | 4.9 | 4.9 | 5.5 | A |
| 4 | $1.5\times10^3$ | 12 | 16 | 24 | 26 | 22 | 4.7 | 4.4 | 4.0 | 4.1 | 6.3 | 2.9 | 3.7 | 9.8 | B |
| 5 | $4.8\times10^3$ | 64 | 28 | 7 | 1 | 0 | 0.7 | 9.8 | 9.8 | 9.6 | 9.9 | 9.7 | 9.6 | 9.9 | A |
| 6 | $4.8\times10^3$ | 12 | 16 | 24 | 26 | 22 | 4.7 | 10.1 | 9.0 | 9.2 | 12.6 | 7.3 | 8.6 | 18.3 | B |
| 7 | $6.4\times10^4$ | 76 | 20 | 4 | 0 | 0 | 0.6 | 20.3 | 19.8 | 20.3 | 20.6 | 20.0 | 21.1 | 20.8 | A |
| 8 | $2.3\times10^5$ | 12 | 16 | 24 | 26 | 22 | 4.7 | 15.9 | 15.8 | 15.7 | 16.3 | 16.0 | 16.1 | 15.9 | B |
| 9 | $6.7\times10^5$ | 12 | 16 | 24 | 26 | 22 | 4.7 | 10.6 | 10.5 | 10.4 | 10.6 | 10.5 | 10.5 | 10.7 | B |

TABLE 1-continued

| Test No. | Viscosity of aqueous mixture cP | Size distribution and median size of iron oxide powder: ≦1 μm (wt. %) | 1~2 μm (wt. %) | 2~5 μm (wt. %) | 5~10 μm (wt. %) | > 10μm (wt. %) | Median size (μm) | Content of iron oxide in aqueous mixture (wt. %): Just after mixing | After 1 day settlement: Upper layer | Middle layer | Bottom layer | After 1 week settlement: Upper layer | Middle layer | Bottom layer | Remarks |
|---|---|---|---|---|---|---|---|---|---|---|---|---|---|---|---|

A: According to the invention
B: Outside the scope of the invention

Next, we have examined influence of the viscosity of the aqueous mixture on the loading of iron oxide on roll. The test was carried out by spraying an aqueous mixture containing a varied content of iron oxide powder and having a varied viscosity as indicated in Table 2 over a rotating roll of a test assembly shown in FIG. 1, and determining a weight of the iron oxide loaded on the roll. In FIG. 1, reference numeral 1 designates a rolling roll having a diameter of 350 mm and a barrel length of 300 mm and rotating at a rotating speed of 30 rpm; reference numeral 2 designates a means for supplying an aqueous mixture, and each aqueous mixture was sprayed over the surface of the roll 1 through a nozzle 3 by means of a pump pressure of 100 kg/cm$^2$; and reference numerical 4 designates a means for spraying water, and water was sprayed over the surface of the roll 1 through a nozzle 5 by means of a pump pressure of 3 kg/cm$^2$. This water supplied corresponds to water for cooling rolls in conventional hot rolling processes. The iron oxide powder used was $Fe_3O_4$ powder having a median size of 0.9 μm and a maximum size of 4 μm. The viscosity of the aqueous mixture was varied by varying the amount of polyacrylic acid added to the aqueous mixture as a thickener. The aqueous mixture and water were sprayed over the roll for a period of 10 seconds. At the end of the period the supply of the aqueous mixture and water was stopped, the aqueous mixture loaded on the roll was collected and the weight of iron oxide contained therein was determined. Results are shown in Table 2.

high spray energy is required. In order that the aqueous lubricant containing iron oxide powder dispersed therein is practically useful, the content of the iron oxide powder should be within the range between 1 and 30 fi by weight and the viscosity should be adjusted within the range between $1\times10^3$ and $5\times10^5$ cP (centipoise), as substantiated by Table 2.

The problem of roll scoring during hot rolling of stainless steel has been solved by the aqueous lubricant according to the invention, as hereinafter demonstrated by Examples. In treating waste liquid from the lubricant according to the invention, special considerations as in the case of oil are not required, since the lubricant according to the invention comprises water, iron oxide powder and a minor amount of water soluble thickener; and troubles of clogging of waste liquid pipes do not happen, since the viscosity of waste lubricant can be readily and quickly reduced by diluting the liquid with water. Upon hot rolling of stainless steel, the lubricant according to the invention can be suitably used in a roughing mill and in the first three stands of a finish rolling mill. The lubricant according to the invention may be conveniently supplied in the form of sprayed mist to a roll bite at the inlet side of the mill. The iron oxide powder contained in the lubricant introduced into the roll bite coats a surfaces of each roll, whereby a direct metal to metal contact between the roll and the material being rolled, and in turn roll scoring, is prevented. The lubricant according to the invention effectively serves to prevent roll scoring

TABLE 2

| Test No. | Content of iron oxide in aqueous mixture (wt. %) | Viscosity of aqueous mixture (cP) | Sprayed weight of: Aqueous mixture (g/10 sec) | Iron oxide (g/10 sec) | Weight of iron oxide loaded on roll (g) | % loading of iron oxide (%) | Remarks |
|---|---|---|---|---|---|---|---|
| 1 | 5.3 | $7.6\times10^2$ | 76 | 4.0 | 1.1 | 28 | B |
| 2 | 10.3 | $2.1\times10^3$ | 67 | 6.9 | 5.0 | 72 | A |
| 3 | 5.4 | $1.2\times10^4$ | 68 | 3.7 | 3.1 | 84 | A |
| 4 | 38.3 | $6.5\times10^5$ | * | * | * | — | B |
| 5 | 10.1 | $5.8\times10^4$ | 53 | 5.4 | 4.9 | 91 | A |
| 6 | 5.8 | $7.0\times10^5$ | * | * | * | – | B |

*: Because of high iron oxide content and/or high viscosity of the aqueous mixture, spraying of the aqueous mixture over the roll was impossible.
A: According to the invention
B: Outside the scope of the invention As seen from Table 2, the loading of iron oxide on roll greatly depends upon the viscosity of the aqueous mixture. If the viscosity of the aqueous mixture is unduly low, the iron oxide powder sprayed over the roll is diluted and washed away by cooling water, resulting in an unsatisfactorily low % loading of iron oxide. Whereas if the viscosity of the aqueous mixture is unduly high, it becomes practically impossible to realize proper spraying, since an extraordinary during rolling of stainless steel. This effect of the lubricant according to the invention to prevent roll scoring during rolling of stainless steel is not substantially affected by the presence or absence of a lubricant oil which has been used during rolling of mild steel. Accordingly, alternate rolling of mild steel and stainless steel by one and the same hot rolling mill can be conveniently carried out without difficulty, using the lubricant according to the invention.

Example 1

A material to be rolled having a thickness of 20 mm, a width of 50 mm and a length of 150 mm, of a SUS430LX stainless steel (containing 0.02% C, 0.51% Si, 0.28% Mn, 0.017% P, 0.004% S, 17.23% Cr, 0.11% Ni and 0.41 $ Nb) was hot rolled with rolls made of a hot work steel (SKD61) and having a diameter of 150 mm The rolling temperature was 900° C., and the rolling was one pass rolling with a rolling reduction of 70%. The material to be rolled was heated to the rolling temperature under an inert gas in a furnace for a short period of time to provide the smallest possible amount of surface scale (the thickness of scale being about 1 μm).

In all runs, cooling water was sprayed over the rolls by means of a pump of 3 kg/cm$^2$ pressure. In one run, no lubricant was supplied. In the remaining runs, lubricants indicated in Table 3 were sprayed over the rolls by means of a pump of 100 kg/cm$^2$ pressure.

The lubricants used comprised viscous aqueous solutions of varied amounts of polyacrylic acid having dispersed therein varied amounts of $Fe_3O_4$ powder having a median size of 0.9 μm with a maximum size of up to 4 μm. The $Fe_3O_4$ powder content and the viscosity of the aqueous mixtures are indicated in Table 3. In each run, occurrence (yes or no) of roll scoring was determined by visually observing surfaces of the rolls and the hot rolled material. Results are shown in Table 3.

TABLE 3

| Run No. | Lubricant: $Fe_3O_4$ content (wt. %) | Lubricant: Viscosity of aqueous mixture (cP) | Roll scoring | |
|---|---|---|---|---|
| 1 | * | * | Yes | C |
| 2 | 0.5 | $4.3 \times 10^4$ | Yes | B |
| 3 | 5.3 | $6.2 \times 10^2$ | Yes | B |
| 4 | 5.9 | $4.1 \times 10^4$ | No | A |
| 5 | 15.3 | $8.3 \times 10^4$ | No | A |
| 6 | 40.9 | $6.9 \times 10^5$ | Yes** | B |
| 7 | 9.6 | $8.2 \times 10^5$ | Yes** | B |

*: No lubricant was used.
**: Lubricant could not be well sprayed over the rolls.
A: Runs according to the invention
B: Comparative runs
C: Control run Table 3 reveals that the lubricant according to the invention effectively serves to prevent roll scoring during hot rolling of stainless steel.

More specifically, in Control Run No. 1 wherein no lubricant was used, it was observed that portions of surfaces of the hot rolled material were plucked off because of roll scoring by with underlying metal exposed. In contrast, in Runs Nos. 4 and 5 wherein lubricants according to the invention were used no roll scoring was observed. This is believed because surfaces of the material to be rolled had been covered by layers of iron oxide powder. In Comparative Run No. 2 or 3 wherein the iron oxide powder content of the aqueous mixture was unduly low or the viscosity of the aqueous mixture was too low, roll scoring could not completely be prevented. In Comparative Runs No. 6 and/or 7 wherein the iron oxide powder content of the aqueous mixture was unduly high and/or wherein the viscosity of the aqueous mixture is too high, the aqueous mixture could not be well sprayed over the rolls due to clogging of spraying nozzles, and in consequence, roll scoring could not be prevented.

Example 2

Slabs having a thickness of 200 mm, a width of 1030 to 1120 mm and a single slab weight of 13 ton, of a SUS430 stainless steel (containing 0.02 to 0.06% C, 0.41 to 0.51% Si, 0.18 to 0.23% Mn, 0.018 to 0.022% P, 0.002 to 0.011% S, 16.27 to 16.53% Cr, and 0.10 to 0.14% Ni) and of a SUS430LX stainless steel (containing 0.003 to 0.01% C, 0.44 to 0.52% Si, 0.14 to 0.28% Mn, 0.014 to 0.024% P, 0.001 to 0.010% S, 16.93 to 17.14% Cr, 0.07 to 0.14% Ni, and 0.38 to 0.41% Ni) were heated to a temperature of 1200° C., roughed to rough bars having a thickness of 25 mm, and hot rolled by means of a finish hot rolling mill comprising 6 stands to hot coils having a thickness of 3.2 to 3.8 mm.

In the first to third stands of the finish hot rolling mill, high chromium rolls were used as work rolls. The first to third stands of the mill were provided with a conventional system for supplying a known lubricant oil by water injection and with a system for spraying an aqueous lubricant according to the invention over the rolls. By means of such a finish hot rolling mill, 18 SUS430 slabs and 8 SUS430LX slabs were hot rolled to provide hot coils having the above-mentioned thickness, using either the known lubricant oil or the aqueous lubricant according to the invention. For each of the so prepared hot coils occurrence of surface defects caused by roll scoring was examined.

Results are shown in Table 4, from which it can understood that the lubricant according to the invention is more effective to prevent roll scoring than the known conventional lubricant oil. More specifically, in the case of the conventional lubricant oil, pickup of steel and roll scoring occurred primarily in the vicinity of coil edges where a high plane pressure exerted during the hot rolling process and defects looking like something included were formed on surfaces of the rolled material. Whereas in the case of the lubricant according to the invention surface defects due to roll scoring were not found in all coils prepared from 18 SUS430 slabs and 8 SUS430LX slabs.

TABLE 4

| | Rolled steel species | Lubricant | Surface defects | Remarks |
|---|---|---|---|---|
| 1 | SUS430 | Lubricant oil* | Surface defects in 8th and subsequent coils | B |
| 2 | SUS430 | Lubricant according to the invention** | No surface defects in all 18 coils | A |
| 3 | SUS43OLX | Lubricant oil* | Surface defects in 3rd and subsequent coils | B |
| 4 | SUS43OLX | Lubricant according to the invention** | No surface defects in all 8 coils | A |

*: Lubricant oil primarily comprised of an animal fat
**: Aqueous mixture having a viscosity of $6.8 \times 10^4$ cP and comprising an aqueous solution of polyacrylic acid having dispersed therein 10% by weight of iron oxide powder which has a median size of 0.8 μm with a maximum size of 5 μm and which primarily comprised of $Fe_3O_4$ and $Fe_2O_3$.
A: According to the invention
B: Conventional As described above, the lubricant according to the invention is effective to prevent roll scoring in rolling of stainless steel, thereby contributes to the production of stainless steel not only in enhancing product quality but also in reducing roll costs and in enhancing efficiency of hot rolling process. While the invention has been described about a special plastic working process called hot rolling, the lubricant described herein can also be advantageously used in other plastic working processes such as extrusion.

We claim:

1. An aqueous lubricant for use in hot rolling of a stainless steel slab which is a non-oily lubricant to be sprayed over surfaces of hot rolling rolls during the hot rolling of stainless steel, which lubricant comprises a viscous aqueous solution of water soluble high molecular weight thickener and from 1 to 30% by weight of iron oxide powder dispersed in said aqueous solution, at least 90% by weight of said iron oxide powder having a particle size not exceeding 10 μm, said lubricant having a viscosity within the range between $1\times10^3$ and $5\times10^5$ cP (centipoise) at ambient temperature.

2. The aqueous lubricant in accordance with claim 1 wherein the iron oxide powder comprises $Fe_3O_4$.

3. The aqueous lubricant in accordance with claim 1 wherein said high molecular weight thickener is selected from the group consisting of polyacrylic acid, polymethacrylic acid, polyacrylamide, polyethylene oxide, polysodium acrylate, polyvinyl alcohol, carboxymethyl cellulose and methyl cellulose.

4. A method of preventing roll scoring during the hot rolling of stainless steel comprising the steps of:

a) providing a stainless steel;

b) hot rolling said stainless steel in a rolling mill;

c) applying an aqueous lubricant to a whole length of working rolls of said rolling mill, said aqueous lubricant further comprising a non-oily, viscous aqueous solution of water soluble high molecular weight thickener and from 1 to 30% by weight of iron oxide powder dispersed in said aqueous solution, at least 90% by weight of said iron oxide powder having a particle size not exceeding 10 μm, said lubricant having a viscosity within the range between $1\times10^3$ and $5\times10^5$ (centipoise) at ambient temperature, use of said aqueous lubricant preventing scoring of said rolls.

5. The method of claim 4 wherein the iron oxide powder comprises $Fe_3O_4$.

6. The method of claim 4 wherein said high molecular weight thickener is selected from the group consisting of polyacrylic acid, polymethacrylic acid, polyacrylamide, polyethylene oxide, polysodium acrylate, polyvinyl alcohol, carboxymethyl cellulose and methyl cellulose.

7. The method of claim 4 wherein said aqueous lubricant is sprayed directly towards said rolls.

8. The method of claim 4 wherein said aqueous lubricant is sprayed at an inlet roll bite of said rolls.

9. The method of claim 4 wherein said rolling is performed with high chromium steel working rolls.

* * * * *